US006006502A

United States Patent [19]

Smith

[11] Patent Number: 6,006,502

[45] Date of Patent: Dec. 28, 1999

[54] WRAPPING STATION SYSTEM AND METHOD

[76] Inventor: Steven Lot Smith, 5706 S. Lisbon Way, Aurora, Colo. 80015

[21] Appl. No.: 09/158,804

[22] Filed: Sep. 22, 1998

[51] Int. Cl.[6] ..... B65B 11/00; B65D 69/00

[52] U.S. Cl. ..... 53/461; 53/219; 53/136.3; 206/575; 206/225

[58] Field of Search ..... 53/219, 218, 390, 53/136.4, 136.3, 415, 465, 461; 206/575, 225; 269/289 R, 295, 16, 901; 83/614; 312/258, 244

[56] References Cited

U.S. PATENT DOCUMENTS

| | | | |
|---|---|---|---|
| 166,038 | 4/1875 | Stepp | 269/295 |
| 653,111 | 4/1900 | McIntire | 269/295 |
| 1,449,073 | 3/1923 | Thom | 53/465 |
| 4,129,213 | 12/1978 | Fleig | 206/575 |

*Primary Examiner*—Peter Vo
*Assistant Examiner*—Matthew Luby
*Attorney, Agent, or Firm*—Ramon L. Pizarro; Edwin H. Crabtree

[57] ABSTRACT

A device and method for storing wrapping materials, measuring and cutting wrapping paper with a cutting tool, and hand wrapping items. The device includes a platform with a work surface having a pair of sides and grooves at predetermined locations between the sides. The platform is supported at a predetermined height by a plurality of storage compartments. Some of the storage compartments have been adapted for holding wrapping paper, some include drawers adapted for holding related materials and tools. The device allows a user to take an item to be hand wrapped and place it over the surface, where an amount of wrapping paper to be used to cover the item to be hand wrapped can be determined from the numbered grooves on the work surface. The amount of wrapping paper to be used may be cut by sliding the cutting tool along said grooves.

16 Claims, 5 Drawing Sheets

WRAPPING STATION SYSTEM AND METHOD

BACKGROUND OF THE INVENTION (a) Field of the Invention

This invention generally relates to a device and method for storing the necessary tools and materials, and assisting in the process of, wrapping containers or gifts.

(b) Discussion of Known Art

When giving gifts one traditionally covers the gifts in some sort of wrapping paper. The wrapping paper conceals the gift item, adding an element of surprise, and serves to decorate the exterior of the packaging. Unfortunately, however, during the task of wrapping the gift one encounters many difficulties. One such difficulty is locating and storing wrapping paper in an undamaged condition. Wrapping paper is frequently damaged due to storage in an unprotected manner where, leaving the paper susceptible to creasing and tearing by surrounding objects. Additionally, other materials and equipment used to wrap the gift also have uses other than gift wrapping. Therefore, it is likely that these materials and equipment are found somewhere other than where the gift wrap is found.

Once the materials and equipment have been located, it is often difficult to find an adequate spot over which to cut the wrapping paper and to support the gift being wrapped. Additionally, in order to produce a neat looking package it is necessary to ensure that the adequate amount of wrapping paper is used. Too much wrapping paper will produce a wrinkled appearance, and obviously, too little will produce unacceptable results. Still further, even if the appropriate amount of paper is marked off on a roll of paper to be used in wrapping the gift, an uneven cut can lead to wasting of the entire section of paper.

Thus there remains a need for a device and system that allows one to store wrapping materials and tools, and to create a wrapping over the gift in a neat, tidy manner. Known devices that helped the user in creating such a wrap is taught in U.S. Pat. No. 4,186,833 to Homan. The Homan device includes means for storing ribbon spools within the box. However, the Homan device does not address the needs of providing the cutting surface, a measuring surface, storage for the required tools, or other problems associated with wrapping a box or a gift.

Many devices provide new and useful containers for storing various artifacts, but few allow the container to be used as a tool which can cooperate with the materials to be stored in the container. For example, U.S. Pat. Nos. 5,718,100 to Petty, 5,603,558 to Zimmer, 4,832,193 to Kime and 2,869,769 to Robinson. Others have limited amount of cooperation with articles to be stored therein, for example U.S. Pat. Nos. 4,659,154 to Jenkins and 1,946,276 to De Castro-Barberena.

While the use of tools to measure and cut paper are known, as shown in U.S. Pat. Nos. 5,480,080 to Ferguson, 4,796,792 to Nelson et al., there remains a need for a device and system that allows user to conveniently store the needed tools, and then use the storage container to measure, cut, and fold paper to create a neat wrapping.

SUMMARY

It has been discovered that the problems left unanswered by known art can be solved by providing a wrapping station and a method for wrapping which includes:

a platform that includes:

1) a surface with a grid formed from grooves for measuring and guiding a cutting tool; and 2) a plurality of storage bins or compartments on a side opposite to the surface with a grid.

In a highly preferred embodiment of the invention the surface of the invention is foldable to allow the invention to collapse for storage of the device when not in use. Additionally, the device includes compartments which have been adapted for storage of various rolls of wrapping paper, compartments which have been adapted for holding ribbons, bows, and the like, compartments adapted for tools such as scissors or cutting blades or edges, a compartment with a support for a spool of adhesive tape, and a compartment for storing collapsible boxes, such as paperboard garment boxes or related supplies.

According to the embodiment of the invention with a folding, measuring and cutting surface, the cutting surface includes ends, each end including a dispensing tray that has been adapted for receiving a roll of wrapping paper when the measuring and cutting surface is unfolded. These tray sections include portions which meet and serve as handles when this embodiment of the invention is folded. In a highly preferred embodiment of the invention one tray is configured for receiving a roll of wrapping paper and, thus, allows the tray to serve as a wrapping paper dispensing tray. Additionally, the end of the cutting surface next to this dispensing tray includes a sharply defined or pronounced edge that contacts the wrapping paper as it is being dispensed from the tray. As the edge contacts the paper, the mechanical contact of the edge against the paper removes the paper's tendency to curl back into a roll configuration.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
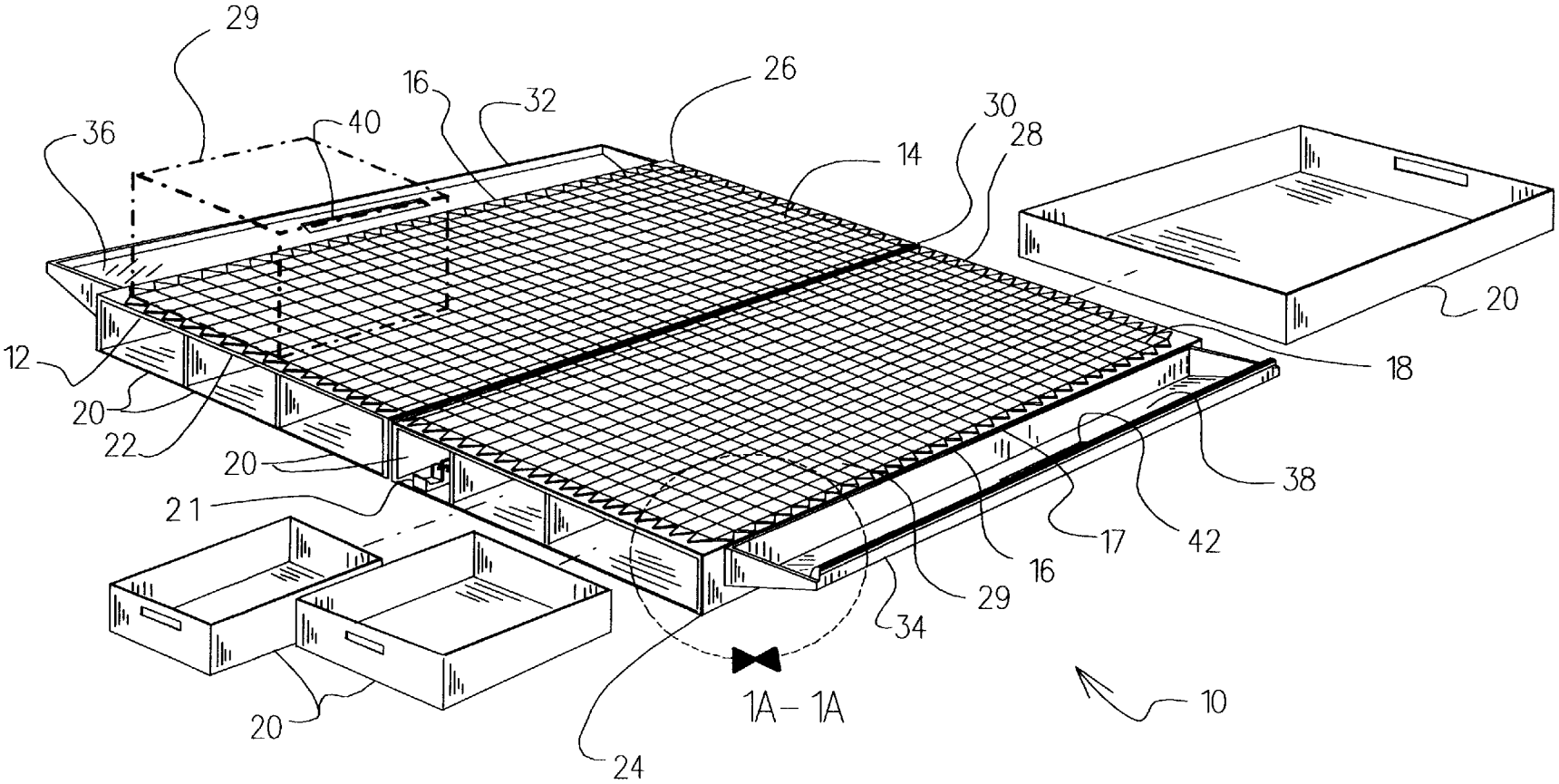
FIG. 1 is a perspective view of a highly preferred embodiment of the disclosed invention with an item to be wrapped shown in dashed lines.
Figure 1A:
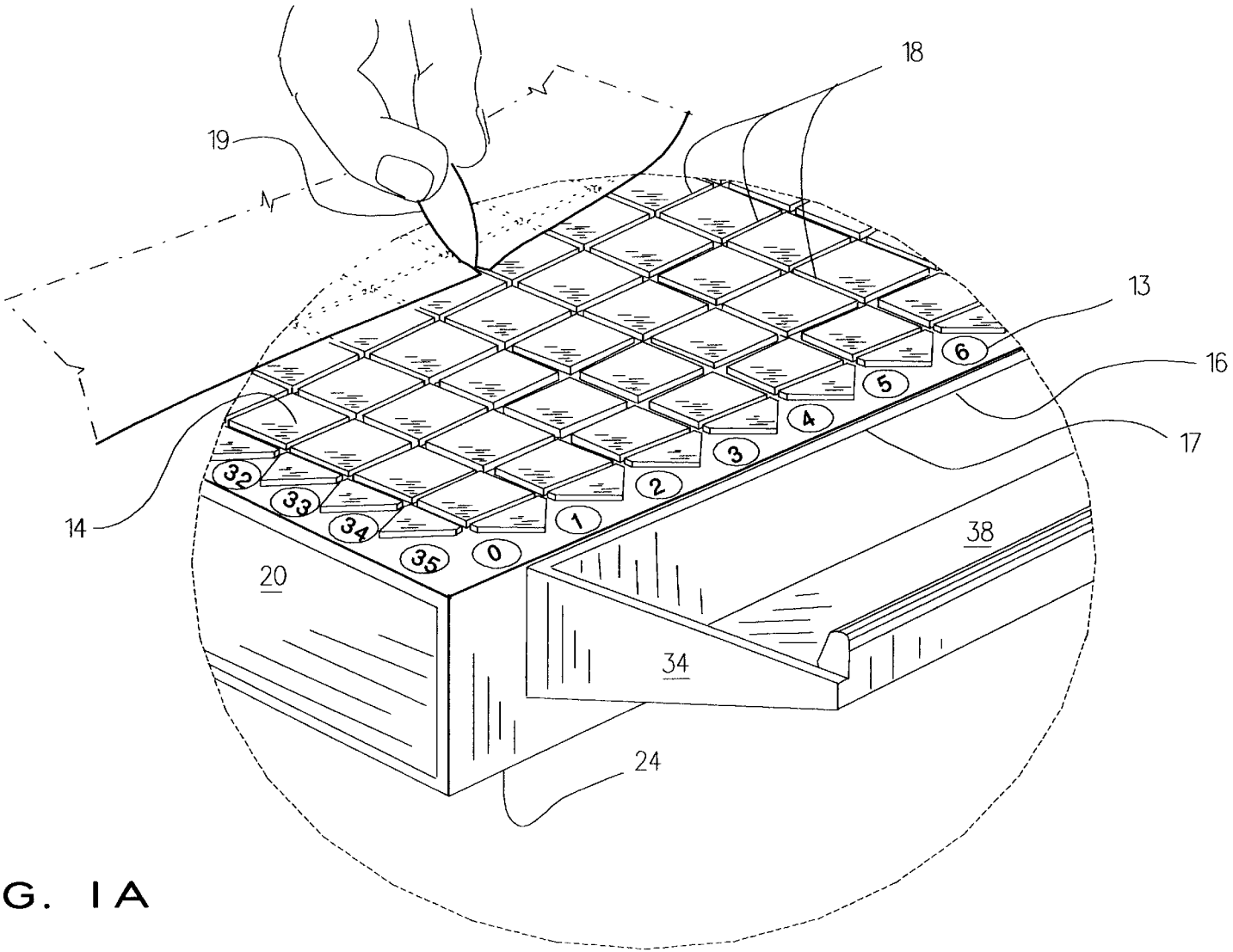
FIG. 1A is closeup of the area indicated in FIG. 1.

Turning now to FIGS. 1 and 1A where a preferred embodiment of a wrapping station 10, which serves as a device for storing wrapping materials, dispensing, measuring and cutting a section of wrapping paper with a cutting tool, and for hand wrapping items, is illustrated. The appended figures show that a highly preferred embodiment of the wrapping station 10 includes a folding platform 12 which includes a work surface 14. The work surface 14 includes a pair of sides 16 on opposite ends of the work surface. Between the sides 16 extend grooves 18, at predetermined locations between the sides 16. The grooves 18 serve as guides for cutting wrapping material, such as gift wrap paper, and will preferably include numbering or indicia 13 for measuring the wrapping material prior to cutting the material. As shown on FIG. 1A, it is contemplated that the grooves 18 may be used to guide a rigid cutting tool 19 along the grooves 18 to cut or score the wrapping material.

Also shown on FIG. 1 is that a highly preferred embodiment of the wrapping station 10 includes several storage means 20. These storage means 20 will preferably include drawers which are positioned immediately below the work surface 14. One of the drawers will be adapted for storing ribbons and the like. Another drawer will allow the user to store greeting cards and the like. Yet another drawer will allow the user to store tools used in the process of wrapping. These tools include cutting devices, such as scissors, blades, writing instruments, and the like. Still another drawer will preferably hold collapsible garment boxes, or other related supplies. In a highly preferred embodiment of the invention an adhesive tape dispenser 21 will be permanently attached or tethered to one of the storage means 20.

Also shown on FIG. 1, is that a preferred embodiment of the folding platform 12 of the wrapping station 10 is formed from a pair of sections 22 and 24, each section 22 and 24 includes surface sections 26 and 28. The storage means 20 will preferably be integral with the surface sections 26 and 28, and lie immediately below, and next to the surface sections 26 and 28. It has been found that this arrangement provides support and rigidity to the surface sections 26 and 28, while providing the necessary storage and placement of tools and materials needed for wrapping articles.

Figure 2:
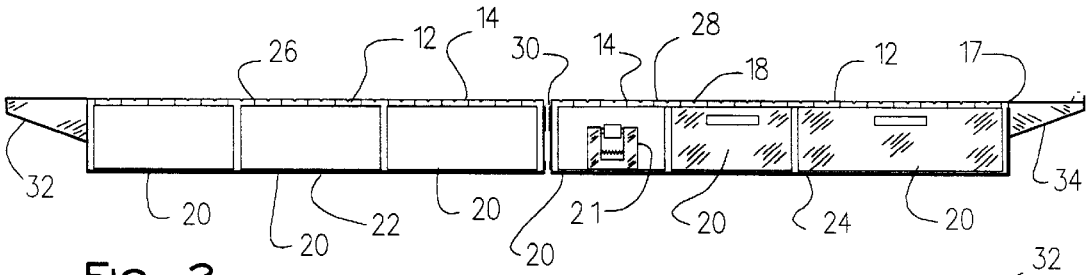
FIG. 2 is an end view looking at the two sections and drawers used for holding tools and materials.
Figure 4:
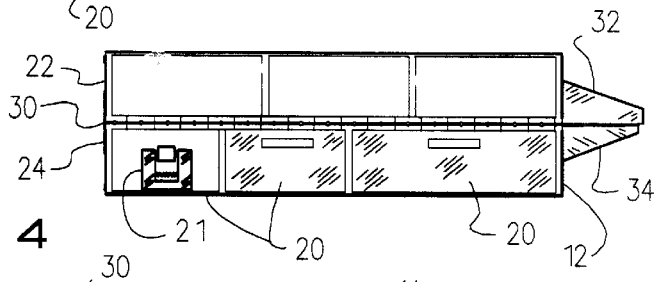
FIG. 4 is an end view of the end opposite to the end shown on FIG. 3, with the device being in a folded position, and shows the use of drawers and pigeonhole style means for holding material such as wrapping paper as well as the attached adhesive tape dispenser.
Figure 3:
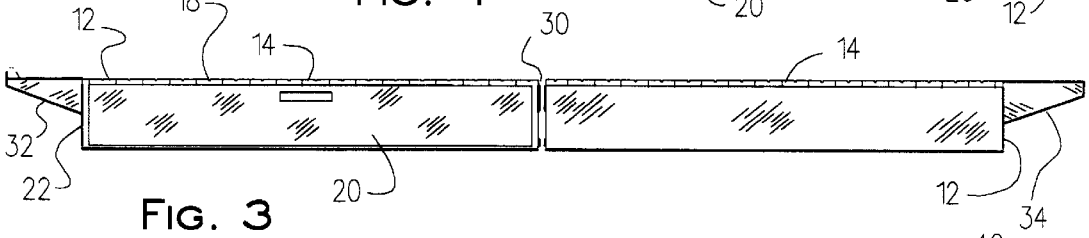
FIG. 3 is an end view looking at the two sections and drawer used for holding collapsed garment boxes.
Figure 5:
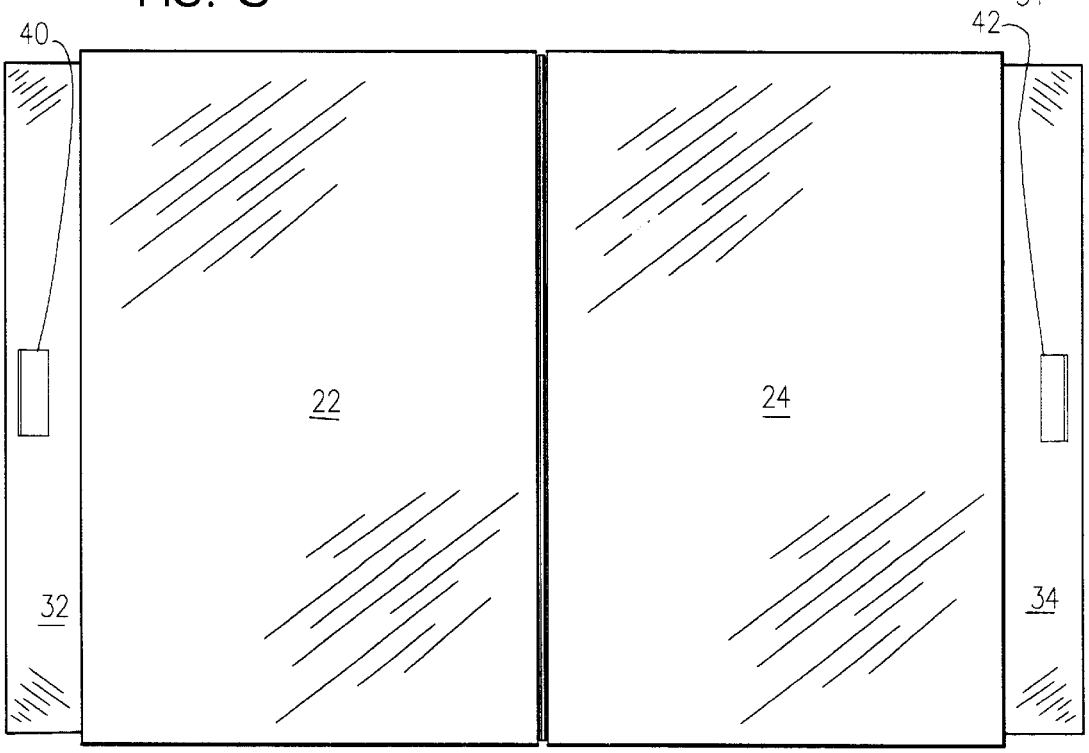
FIG. 5 is a bottom view of a highly preferred embodiment of the invention.
Figure 6:
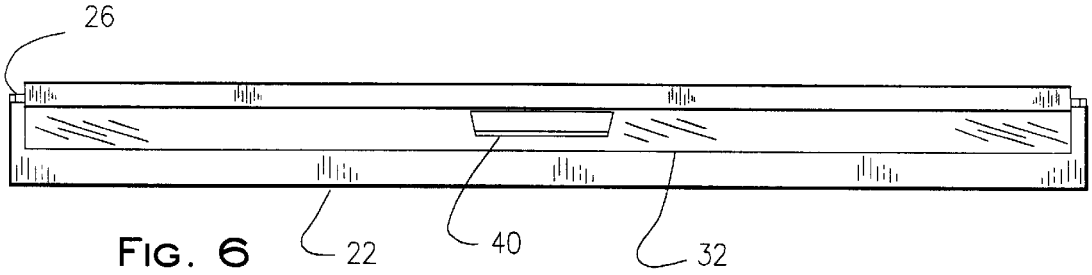
FIG. 6 is an end view of one of the sections of a highly preferred embodiment of the invention.
Figure 6A:
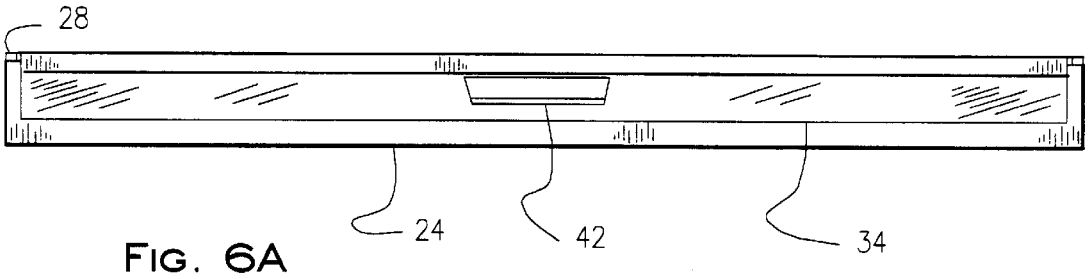
FIG. 6A is an end view of one of the sections of a highly preferred embodiment of the invention, the section mating with the section shown in FIG. 6.

Referring to FIGS. 2 through 5 it will be understood that the sections 22 and 24 are preferably joined together by a hinge means 30 which allows the surface sections 26 and 28 to move, together with the sections 22 and 24, between a first position, illustrated in FIGS. 2, 3 and 5, where the surface sections 26 and 28 are substantially coplanar with one another to form the work surface 14. The hinge means 30 will allow the sections 22 and 24 to fold and move relative to one another from the first position illustrated in FIGS. 1, 2, 3, 5, 6, 6A and 9 a second position, illustrated in FIGS. 4, 7 and 8, where the sections 22 and 24 are over, and substantially parallel to, one another, with the surface sections 26 and 28 facing one another.

Turning to FIGS. 1, 2, 3, 6, 6A and 9, it will be understood that a highly preferred embodiment of the invention includes dispensing trays 32 and 34, which extend away and below the work surface 14. More specifically, in a highly preferred embodiment of the invention each of the dispensing trays 32 and 34 include a bottom 36 and 38, respectively. The bottoms 36 and 38 commence at a point below the work surface 14. It has been discovered that the use of the bottoms 36 and 38 at a point below the work surface 14, and by terminating the side 16 next to the tray with a sharp edge 17, one produces a device that allows the user to place a roll of paper, for example, in the tray, the position of the bottoms of the tray will accept the rolled up ends and prevent the paper from rolling up once again due to its own resiliency. As the user unrolls the paper from the tray, the paper will contact the edge 17. The contact with the edge 17 will alleviate the bias of the paper which urged the paper to curl up back into its original, rolled up, arrangement. Thus, the placement of the tray next to, and below the edge 17 allows the user to place a roll of paper and unroll the paper and remove the paper's tendency to curl as the paper contacts the edge 17.

To use the tray and have the edge 17 to relieve the bias of the paper, the user should place the roll in the tray with the direction of the curl being away from the edge 17. In other words, the paper should be placed in the tray such that the paper curls away from the work surface 14 when following a "right hand rule" of orientation. The right hand rule states that aligning the extended thumb of the right hand with the edge 17 and then following the direction of the fingers as they curl towards or over the palm. Therefore, to use the edge 17 one would place a roll of paper in the tray 34 with the paper rolled up in the direction that the fingers would curl while aligning the right hand thumb with the edge 17, with the palm facing up.

In a highly preferred embodiment of the invention it is contemplated that a single tray, such as tray 34, with an accompanying edge 17 will be incorporated into the wrapping station 10. However, it is important to note that it is contemplated that additional examples of this tray and edge arrangement may be incorporated into any of the various borders of the work surface 14. Therefore, in the illustrated preferred embodiment, it is contemplated that tray 34 will be next to an edge, such as edge 17. Additionally, it is important to note that the bottom 38 of the tray 34 is sloped, so that a roll placed in the tray 34 roll towards the edge 17, holding the roll below the edge 17 to allow constant contact of the paper and the edge 17 as the paper is pulled from a roll held in the tray 34.

Figure 7:
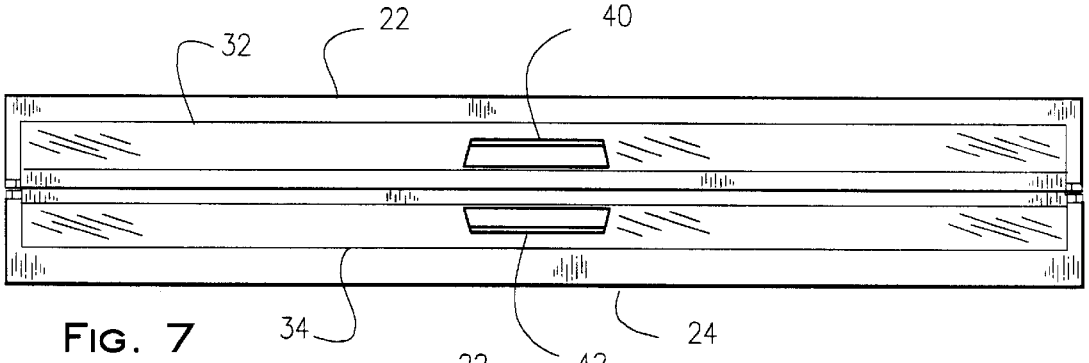
FIG. 7 is an end view, looking in towards the trays, of the embodiment in the folded position as shown in FIG. 4.
Figure 8:
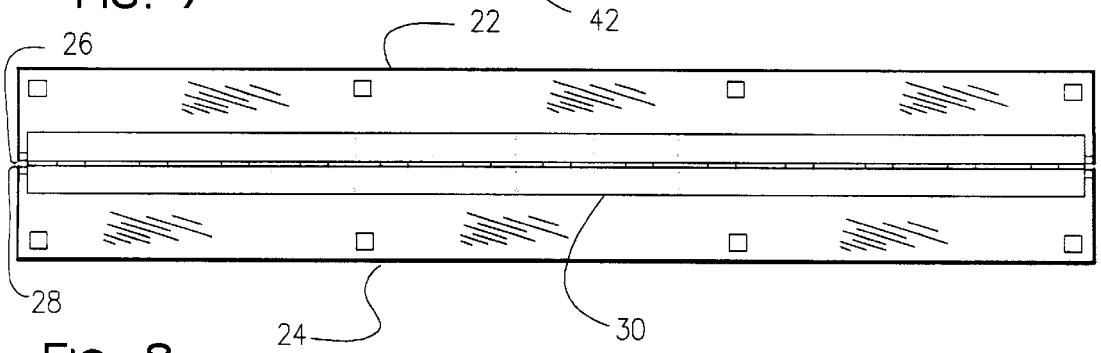
FIG. 8 illustrates the end opposite to the end illustrated in FIG. 7.
Figure 9:
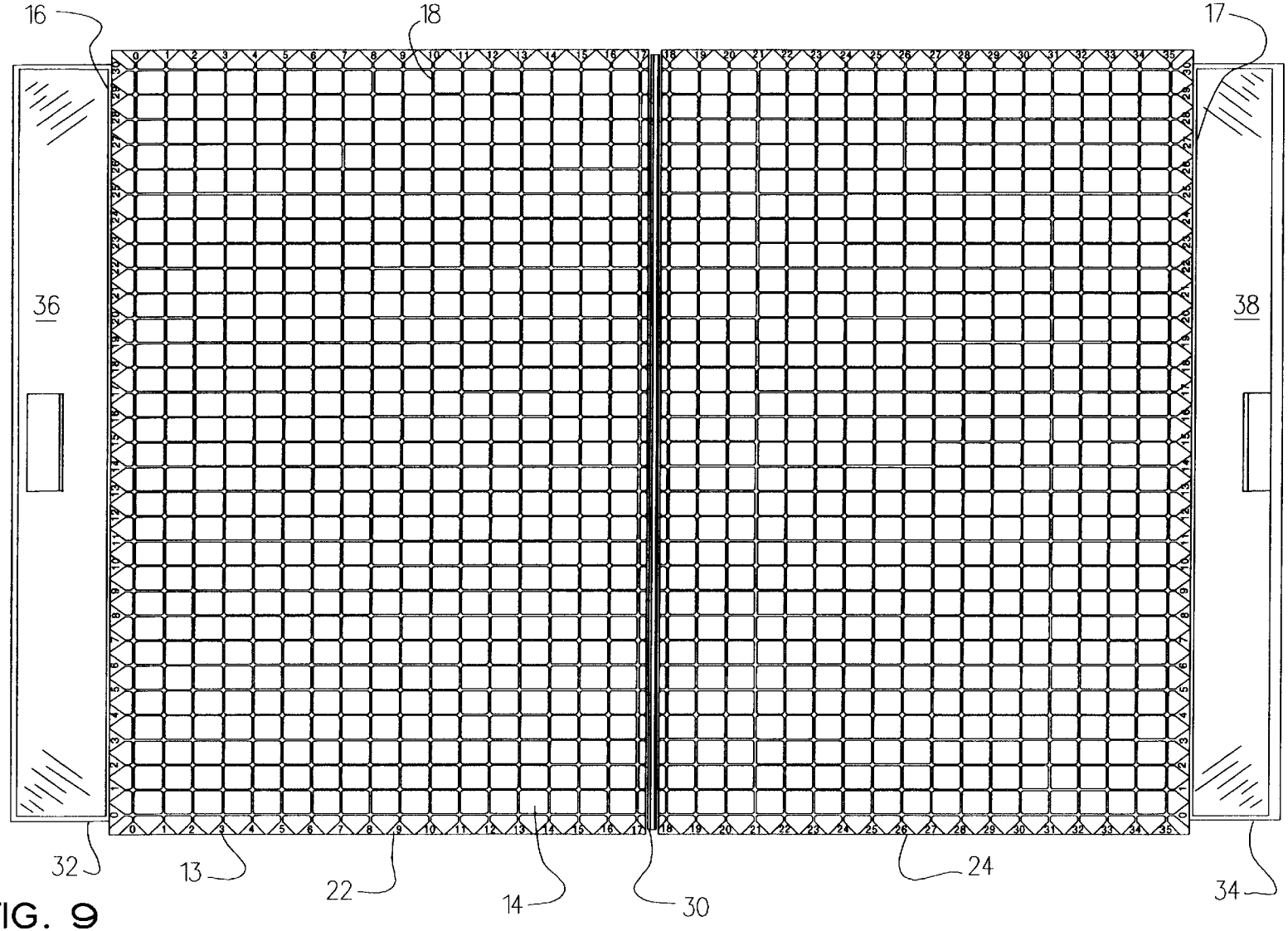
FIG. 9 is a top, plan view of the working surface of the invention as shown in an extended position.

Additionally, as shown on FIGS. 1, 7, and 9, the bottoms 36 and 38 will preferably include apertures 40 and 42. The apertures 40 and 42 will preferably be positioned at opposing locations of the trays 32 and 34, so that when section 22 and section 24 are folded up against one another the apertures 40 and 42 will allow the forming of a handle 44 that will allow the user to grasp and carry the invention. Additionally, it will be understood that when the surface sections 26 and 28 are in the first position, shown on FIGS. 1, 2, 3, 5 and 9 the hinge means 30 will be substantially coplanar with the work surface 14, or the surface sections 26 and 28, allowing the work surface to accept an item to be wrapped 29.

Once an item to be wrapped is placed over the work surface 14, the measuring and cutting of the needed wrapping material to cover the item is facilitated by the grooves 18 on the work surface 14. For example, if a rectangular box having a pair of opposing five by ten inch sides, a pair of opposing three by ten inch sides, and a pair of three by five inch opposing ends is to be wrapped, the user would first place wrapping material and the box over the wrapping material and over work surface 14, near the "0—0" mark shown on FIG. 9. One would then turn the box ¼ turn to the right and read the number on the next groove 18 from the edge of the box. The number read is then multiplied by two to arrive at the required marking to be used as a guide for cutting the paper. This will result in allowing the user to cut the proper amount of paper that is needed to cover the sides of the box. Then, the user will simply roll the box up, over towards the end away from the "0—0" mark, and select the next marking from the edge of the end of the box. This marking will serve to locate the edge of the cut for covering the ends of the box.

It is contemplated that cutting the wrapping material will be greatly simplified by the disclosed invention, due to the fact that the wrapping material may be cut by simply running a thin rigid item over the wrapping material and along one of the grooves 18.

It is important to note that with the disclosed invention the wrapping material may be cut without having to remove the box from the wrapping material. This is because the trays 32 will hold the roll of the wrapping material , and the weight of the box will hold the free end of the wrapping material against the work surface 14.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. A device for storing wrapping materials, measuring and cutting wrapping paper with a cutting tool, and hand wrapping items, the device comprising:

a platform having a work surface having a pair of sides and grooves at predetermined locations between the sides, said platform being supported at a predetermined height by a plurality of storage compartments for holding wrapping paper, so that an item to be hand wrapped is placed over the work surface and an amount of wrapping paper to be used to cover the item to be hand wrapped is measured using the grooves covered by the item to be wrapped, and so that the measured amount of wrapping paper to be used is cut by sliding the cutting tool along said grooves and over the wrapping paper, and so that the item to be wrapped is then placed over the work surface and over the wrapping paper after the wrapping paper has been cut, so that the wrapping paper is manipulated over the work surface to wrap the item to be wrapped.

2. A device according to claim 1 wherein said platform comprises a pair of sections, each section having a surface section, the sections being joined by a hinge means to join said surface sections to form said work surface and to allow folding of said pair of sections.

3. A device according to claim 2 wherein at least one of said storage means includes means for securing an adhesive tape dispensing means to said storage means.

4. A device according to claim 2 wherein one of said sides includes a dispensing tray extending away and below from said work surface and a sharp edge along the side.

5. A device according to claim 4 wherein said dispensing tray includes an aperture in the dispensing tray, the aperture defining a handle, so that when said pair of sections are folded said aperture in said dispensing tray serves as a handle.

6. A device according to claim 5 wherein said storage compartments further comprise:

at least one drawer adapted for storing materials to be used to wrap items.

7. A device for storing wrapping materials, measuring and cutting a section of wrapping paper with a cutting tool, and hand wrapping items, the device comprising:

a folding platform having a work surface having a pair of sides, the surface further having grooves at predetermined locations between the sides, said folding platform including a pair of sections, each section having a surface section and at least one storage means next to the surface section, the sections being hingedly joined to allow said surface sections to move between a first position where said surface sections are substantially coplanar with one another to form said work surface, and a second position where said surface sections are folded over one another and substantially parallel to one another, so that wrapping paper placed over the work surface to be used to cover the item to be hand wrapped is determined by placing the item to be wrapped over the work surface and counting the grooves covered by the item to be wrapped, and so that the amount of wrapping paper to be used is then cut by sliding the cutting tool over the wrapping paper and along said grooves, and so that the work surface is used to support the item to be wrapped, and so that once the paper is cut and over the wrapping paper, and so that the item to be wrapped is then placed over the work surface and over the wrapping paper after the wrapping paper has been cut, so that the wrapping paper is manipulated over the work surface to wrap the item to be wrapped.

8. A device according to claim 7 wherein said surface sections intersect and said hinge means is placed between the intersection of said surface sections so that when said pair of surface sections are in said first position, said hinge means is substantially coplanar with said surface sections and said storage means abut against one another to maintain said surface sections substantially coplanar to one another.

9. A device according to claim 8 wherein at least one of said storage means includes means for securing an adhesive tape dispensing means to said storage means, the adhesive tape dispensing means being attached to said storage means.

10. A device according to claim 8 wherein each of said sides includes a dispensing tray extending away and below from said work surface.

11. A device according to claim 10 wherein each of said dispensing trays includes an aperture defining a handle, so that when said pair of sections are the second position said apertures in each of said dispensing trays align with one another.

12. A device according to claim 11 wherein said storage means further comprises at least one drawer for storing materials to be used to wrap items.

13. A method for providing an amount of wrapping material for wrapping items, the method comprising:

providing a platform having a work surface, the work surface having a pair of sides and grooves at predetermined locations between the sides, said platform being supported at a predetermined height by a plurality of storage means;

providing wrapping materials;

placing said wrapping material over said work surface;

placing the item to be wrapped over the wrapping material over the work surface;

counting the number of grooves covered by the item to be wrapped and selecting a groove that coincides with the location for cutting on the wrapping material;

cutting wrapping material with a cutting tool by sliding the cutting tool through the selected groove over the wrapping material.

14. A method according to claim 13 wherein said platform comprises a pair of sections, each section having a surface section, the sections being joined by a hinge means to join said surface sections to form said work surface and to allow folding of said pair of sections, and the method further comprises unfolding the sections to position the pair of sides in a coplanar arrangement prior to placing the wrapping material over the work surface.

15. A method according to claim 14 and further comprising providing an adhesive tape dispensing means attached to said storage means and providing adhesive tape from the adhesive tape dispensing means and securing the cut wrapping material over the item to be wrapped with adhesive tape from the adhesive tape dispensing means.

16. A method according to claim 13 and further comprising providing at least one dispensing tray and a sharp edge along one of the sides of the platform and positioning the dispensing tray near the share edge, the dispensing tray extending away and below from said work surface, and the step of placing the wrapping material over the work surface further comprises draping the wrapping material into the dispensing tray and pulling the wrapping material over and against sharp edge as the wrapping material is being pulled over the work surface.

* * * * *